United States Patent [19]

Boyd

[11] Patent Number: 4,501,532

[45] Date of Patent: Feb. 26, 1985

[54] THERMAL SHOCK BARRIER FOR INJECTION PUMP

[75] Inventor: Collis E. Boyd, Glen Ellyn, Ill.

[73] Assignee: International Harvester Co., Chicago, Ill.

[21] Appl. No.: 657,038

[22] Filed: Oct. 1, 1984

Related U.S. Application Data

[63] Continuation of Ser. No. 457,996, Jan. 14, 1983, abandoned.

[51] Int. Cl.[3] ..... F04B 21/00; F04B 17/02

[52] U.S. Cl. ..... 417/313; 417/462

[58] Field of Search ..... 417/313, 373, 462; 123/450, 198 E

[56] References Cited

U.S. PATENT DOCUMENTS

| | | | |
|---|---|---|---|
| 3,446,198 | 5/1969 | Simko | 123/140 |
| 4,100,903 | 7/1978 | Roosa | 123/139 AQ |
| 4,336,781 | 6/1982 | Overfield | 123/467 |
| 4,348,993 | 9/1982 | Ueno et al. | 123/198 E |
| 4,362,141 | 12/1982 | Mowbry | 123/450 X |

FOREIGN PATENT DOCUMENTS

| | | | |
|---|---|---|---|
| 1751623 | 7/1978 | Fed. Rep. of Germany | 123/450 |
| 2097557 | 11/1982 | United Kingdom | 123/450 |

OTHER PUBLICATIONS

Hess and Salzgeber "The Stanadyne D82 Distributor Pump for Medium Duty Diesels" Sep. 10, 1979, SAE 790899, pp. 1–4.

*Primary Examiner*—Richard E. Gluck

*Attorney, Agent, or Firm*—Dennis K. Sullivan; F. David Au Buchon

[57] ABSTRACT

A diesel fuel injection pump having a rotary fuel distributor head including a rotor disposed in very close clearance thereinside wherein a thermal shock barrier of an elastomeric material having a low thermal conductivity is disposed about the outside of the distributor head, the barrier having apertures through which the injection pipes pass. In its preferred form, the barrier is a one piece member fitting the distributor head beneath the injection pipe nuts. In an alternative form, the barrier comprises two pieces mating along the injection pipe apertures and enclosing the connections between the injection pipes and the distributor head. The barrier need not be waterproof but must be sufficiently protective of the distributor housing to prevent substantial amounts of water from contacting the distributor head.

4 Claims, 4 Drawing Figures

THERMAL SHOCK BARRIER FOR INJECTION PUMP

This is a continuation of application Ser. No. 457,996, filed Jan. 14, 1983, now abandoned.

This invention relates to fuel injection pumps of the type used on diesel engines and, more specifically, to a thermal shock protector for the fuel distributor or hydraulic head of a rotary fuel injection pump.

Rotary fuel injection pumps of the type described herein are illustrated, for example, in U.S. Pat. Nos. 4,100,903 and 4,336,781 and are commercially embodied in the DB2 Model injection pump sold by Stanadyne, Inc. of Windsor, Conn. and described in S.A.E. paper No. 790899, published Sept. 10, 1979 by the Society of Automotive Engineers, St. Joseph, Mich. and entitled "The Stanadyne DB-2 Distributer Pump for Medium Duty Diesels". The distributor head of these pumps includes a rotor which receives the fuel supply in an axial passage, which contains a delivery valve, and delivers the fuel outwardly through a radial passage sequentially to a plurality of circumferentially spaced radial ports in the distributor head which in turn communicate in the proper order with each cylinder of the engine. Because the pressure of the fuel injected through the passages is typically 3000–6000 psi, very close clearances, on the order of 0.0001 in. are required between the rotor and the distributor head. Although this is generally satisfactory for normal engine operation, if the injection pump were to become submerged, as in a vehicle fording a stream, the distributor head may contract slightly due to the cold water, and cause the rotor to sieze up.

Accordingly, it is a primary object of the invention to provide a means for preventing thermal shock siezure of the injection pump.

This object and others as will hereinafter become apparent are specifically met in a rotary fuel injection pump having a fuel distributor head including a rotor disposed in very close clearance thereinside wherein a thermal shock barrier of an elastomeric material having a low thermal conductivity is disposed about the outside of the distributor head, the barrier having apertures through which the injection pipes pass. In its preferred form, the barrier is a one piece member fitting the distributor head beneath the injection pipe nuts. In an alternative form, the barrier comprises two pieces mating along the injection pipe apertures and enclosing the connections between the injection pipes and the distributor head. The barrier need not be waterproof but must be sufficiently protective of the distributor housing to prevent substantial amounts of water from contacting the distributor head.

BRIEF DESCRIPTION OF THE DRAWINGS

Other objects and advantages of the invention will become more apparent upon reading the detailed description thereof and upon examining the drawings, in which.

DETAILED DESCRIPTION OF THE INVENTION

Figure 1:
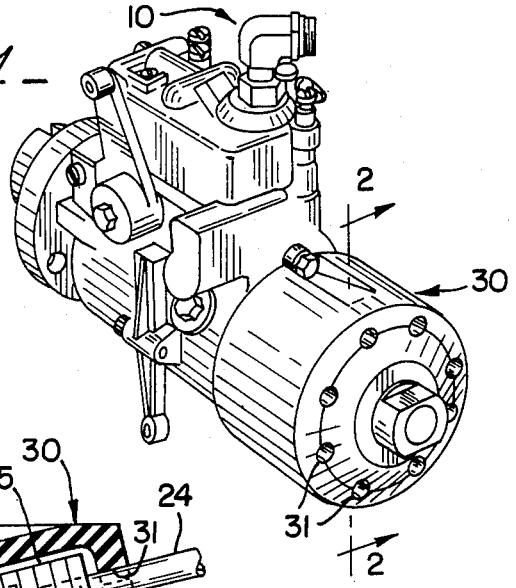
FIG. 1 is a perspective view of a diesel fuel injection pump incorporating the invention.

Referring now to the drawings, there is shown in FIG. 1 a rotary fuel injection pump 10 for a diesel engine which is adapted to be driven by the engine and supplies the engine's fuel requirements. The specific injection pump model illustrated is the DB-2 Rotary Distributor Pump manufactured by Stanadyne Corporation and is described in detail in the aforementioned S.A.E. paper and is similar to that described in the aforementioned patents. For purposes of the present invention, the injection pump 10 includes a housing 11 having a central drive shaft (not shown) connected to a rotor 12 extending rearwardly of the housing. The rotor 12 has an axially extending passage 14 which includes a spring loaded delivery valve 15 and a radial passage 16 intersecting the axial passage 14 rearwardly of the delivery valve. In operation, the cavity behind the delivery valve 15 is periodically brought to high pressure, on the order of 3000 to 6000 psi, to inject fuel into the engine.

A distributor head 18 or hydraulic head is mounted to the pump housing 11 and has a central bore 19 which receives the rotor shaft 12 with very close clearance. The distributor head 18 has a plurality of radial passages 20 equal to the number of cylinders in the engine disposed circumferentially at equal intervals and intersecting the central bore 19 in a position to become in registry with the rotor radial passage 16 upon rotation of the rotor 12. The distributor head passages 20 further communicate respectively with rearwardly facing ports 21 having fittings 22 threaded thereinto. Injection pipes 24 are attached to the fittings 22 by nuts 25 and extend respectively (in the proper firing order) to a fuel injection nozzle (not shown) associated with each cylinder of the engine. It will be appreciated that all of the foregoing is a description of a conventional fuel injection system for a diesel engine utilizing a conventional rotary distributor injection pump.

Figure 2:
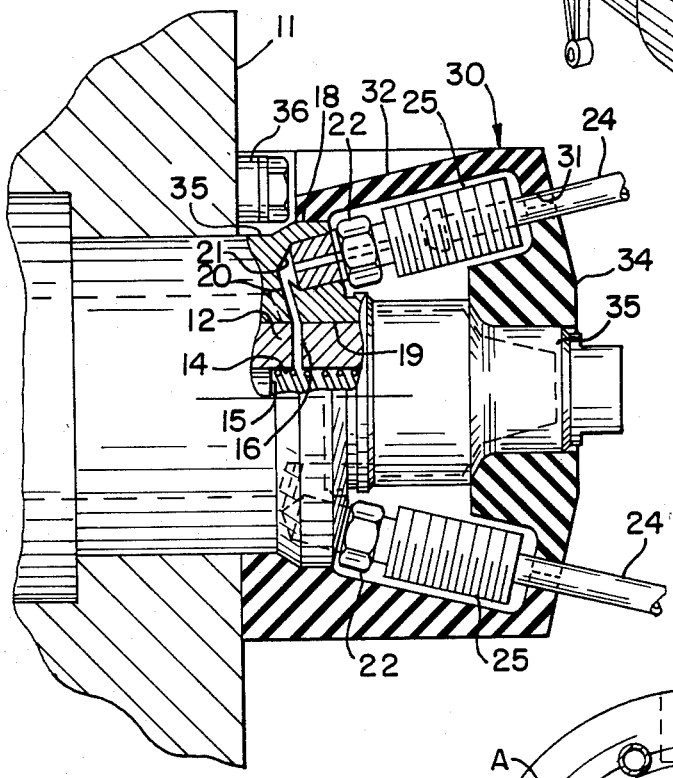
FIG. 2 is an enlarged sectional view axial of the rotor and distributor head of the injection pump of FIG. 1 and showing the fuel injection pipes.
Figure 3:
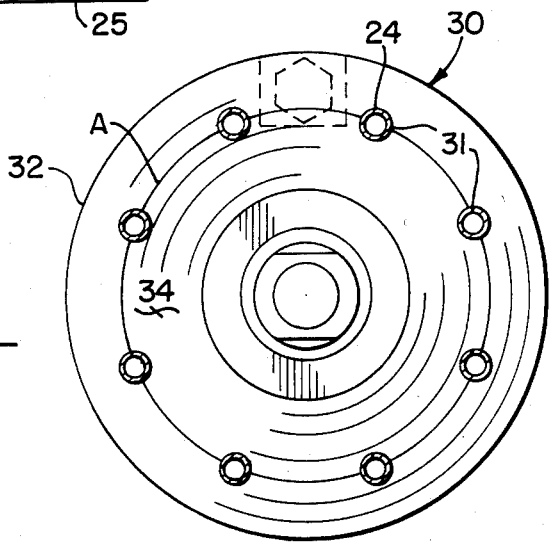
FIG. 3 is an end view of the injection pump shown in FIG. 1, the injection pipes being illustrated in section.

In accordance with the invention, a thermal shock barrier 30 is disposed about the circumference of the distributor head 18 and has apertures 31 through which the injection pipes 24 pass. The thermal shock barrier 30 is made from a pliable, stretchable elastomeric material, preferably Nitrile Butadiene Rubber (NBR) polymer, which is also ozone resistant. In the embodiment illustrated in FIGS. 1–3, the thermal shock barrier 30 has two mating parts including a generally cylindrical outer section 32 covering most of the circumferential surface of the distributor head 18 and a radial section 34 which fits on the end cap 35 of the injection pump and mates with the circumferential section 32 along a parting line A which intersects the apertures 31 for the injection pipes 24. As will be seen from FIG. 2, the barrier 30 encloses the connection of the injection pipe nuts 25 to the distributor head fitting 22 as well as the head itself.

It is not essential that the barrier 30 be completely watertight or waterproof. In fact, in FIGS. 1–3, a small portion 35 of the distributor head beneath the fitting 36 is exposed. The requirement is that it prevent substantial amounts of water from contacting the distributor head especially the circumferential portion thereof. This is best accomplished by sizing the inner diameter of the circumferential portion 32 so it is streched a little upon installation on the distributor head 18 and therefore creates a tight fit therewith preventing water from displacing it.

Figure 4:
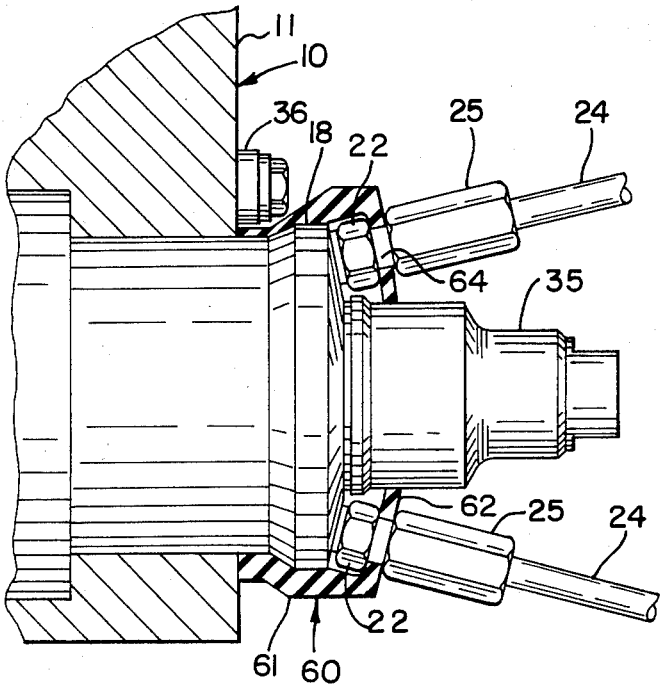
FIG. 4 is a sectional view similar to FIG. 2 illustrating the preferred one piece embodiment of the thermal shock barrier.

The preferred embodiment of the invention is illustrated in FIG. 4 wherein all parts which are the same as the previous embodiment have the same reference numerals. In this embodiment, the thermal shock barrier 60 is a single piece barrier of the same elastomeric material as the above-described barrier 30. The preferred shock barrier 60 has a circumferential portion 61 which fully engages the circumferential periphery of the distributor head 18 of the injection pump 10 and a radial portion 62 which extends from the circumferential portion 61 radially inwardly to contact the end cap 35 of the injection pump. The radial portion 62 has apertures 64 which fit over the injection pipe fittings 22 and leave the threaded portion thereof to be engaged by the injection pipe nuts 25, which are therefor more accessible for removing the injection pipes.

Thus, there has been described, in accordance with the invention, a rotary distributor injection pump and thermal shock barrier which fully meets the object set forth above.

What is claimed is:

1. In combination with a rotary diesel fuel injection pump having a rotor, a distributor head having a cylindrical periphery, a central bore receiving the rotor, and a plurality of output ports adapted to receive fuel from said rotor and supply it to a diesel engine through injection pipe means attached to said distributor head ports, a thermal shock barrier comprising an elastomeric member of low thermal conductivity disposed about and engaging said cylindrical periphery of said distributor head and preventing water from coming in contact with said peripheral portion, said thermal barrier having apertures through which said injection pipe means pass.

2. The invention according to claim 1 and said injection pipe means comprising fittings threaded into said distributor head and injection pipes connected to said fittings, said fittings passing through said apertures and said injection pipes connected to said fittings outside said barrier.

3. The invention according to claim 1 and said barrier comprising a first circumferential member and a separate second radial member, said first and second members mating along a parting line passing through said apertures.

4. The invention according to claim 3 and said injection pipe means including fittings threaded in said distributor head and injection pipes connected to said fittings, said injection pipes passing through said apertures.

* * * * *